US012721453B2

(12) United States Patent
Priester et al.

(10) Patent No.: US 12,721,453 B2
(45) Date of Patent: Sep. 1, 2026

(54) BULK DOSING SYSTEM

(71) Applicant: SOCIETE DES PRODUITS NESTLE S.A., Vevey (CH)

(72) Inventors: Laura Priester, Puidoux (CH); Christian Jarisch, Lutry (CH); Lucio Scorrano, Yverdon-les-Bains (CH); Jonathan Gebs, Gland (CH)

(73) Assignee: Société des Produits Nestlé S.A., Vevey (CH)

( * ) Notice: Subject to any disclaimer, the term of this patent is extended or adjusted under 35 U.S.C. 154(b) by 163 days.

(21) Appl. No.: 18/717,892

(22) PCT Filed: Nov. 18, 2022

(86) PCT No.: PCT/EP2022/082372

§ 371 (c)(1),
(2) Date: Jun. 7, 2024

(87) PCT Pub. No.: WO2023/104470

PCT Pub. Date: Jun. 15, 2023

(65) Prior Publication Data

US 2025/0040728 A1 Feb. 6, 2025

(30) Foreign Application Priority Data

Dec. 10, 2021 (EP) ..... 21213647

(51) Int. Cl.
*A47F 1/03* (2006.01)

(52) U.S. Cl.
CPC ..... *A47F 1/03* (2013.01)

(58) Field of Classification Search
CPC ..... B67D 3/00; B67D 3/0029; B67D 3/0032; B67D 3/0035; B67D 1/06; B67D 3/0009; B67D 1/0004; B67D 1/0462; B67D 2001/0827; A47G 23/0258; B05B 11/0037; B05B 11/0038; B05B 11/026;
(Continued)

(56) References Cited

U.S. PATENT DOCUMENTS 1,800,774 A * 4/1931 Bosecker ..... B65D 47/286 222/149
2,033,256 A * 3/1936 Schacher ..... B65D 47/286 222/480

(Continued)

FOREIGN PATENT DOCUMENTS

CN 111315267 6/2020

OTHER PUBLICATIONS

International Search Report for International Application No. PCT/EP2022/082372 mailed Feb. 8, 2023, 4 pages.

(Continued)

*Primary Examiner* — Donnell A Long
(74) *Attorney, Agent, or Firm* — Thorpe North & Western, LLP

(57) ABSTRACT

The invention relates to a food and/or beverage product container, a dispensing unit and a dispensing system comprising the product container and the dispensing unit. The dispensing unit comprises a handle, the downwards movement of the handle causes the tilting plate of the dispensing unit to be lifted which allows the delivery of the product from the inner volume of the product container through an aperture.

20 Claims, 12 Drawing Sheets

(58) Field of Classification Search
CPC .. B65D 77/065; B65D 83/384; B65D 35/242; B65D 35/56; B65D 77/06; B65D 81/3233; B65D 83/0055; B65D 83/0072; B65D 83/60; B65D 83/62; F25D 23/126
See application file for complete search history.

(56) References Cited

U.S. PATENT DOCUMENTS

| | | | | | |
|---|---|---|---|---|---|
| 2,127,911 | A * | 8/1938 | Horace | B65D 47/286 | 222/561 |
| 2,202,653 | A * | 5/1940 | Glidden | A61M 5/3205 | 220/253 |
| 2,244,071 | A * | 6/1941 | Landrus | B65D 47/38 | 222/561 |
| 4,856,681 | A | 8/1989 | Murray | | |
| 4,856,683 | A | 8/1989 | Murray | | |
| 5,447,255 | A * | 9/1995 | Smedley | B65D 35/285 | 222/102 |
| 5,979,717 | A | 11/1999 | Dalton et al. | | |
| 6,102,259 | A | 8/2000 | Tsamourgelis et al. | | |
| 6,241,123 | B1 | 6/2001 | Elmore | | |
| 2012/0104041 | A1 | 5/2012 | Coleman et al. | | |
| 2023/0135726 | A1 * | 5/2023 | Batzel | B65D 50/04 | 220/812 |

OTHER PUBLICATIONS

Written Opinion of the International Searching Authority for International Application No. PCT/EP2022/082372 mailed Feb. 8, 2023, 5 pages.

* cited by examiner

BULK DOSING SYSTEM

CROSS REFERENCE TO RELATED APPLICATIONS

The present application is a National Stage of International Application No. PCT/EP2022/082372, filed on Nov. 18, 2022, which claims priority to European Patent Application No. 21213647.7, filed on Dec. 10, 2021, the entire contents of which are being incorporated herein by reference.

1. Field of the Invention

The present invention relates to a product container comprising an inner volume for receiving a food and/or beverage product, a dispensing unit for receiving a product container and dispensing system comprising a product container and a dispensing unit.

For the purpose of the present description, a "beverage" is meant to include any human-consumable liquid substance, such as tea, coffee, baby food etc.

2. Technical Background

Bulk food and/or beverage products are items offered in large quantities, which can be purchased in large, bulk lots or transferred from a bulk container into a smaller container for purchase. Bulk food and/or beverage may be priced less compared to packaged foods because they are typically packaged in large generic bulk containers and packaging for grocery outlets, which utilizes lesser natural resources. Additionally, less packaging is congruent with the environmental conservation of natural resources and sustainability.

Bulk buying is a triple win. It reduces packaging waste and allows for portion control, which, in turn prevents food and/or beverage waste. Best of all, it saves money. The consumer may bulk buy products cheaper compared to the prepackaged form of the same products. Some bulk buys offer a lot more packaging savings than other. The products with the most-waste reduction potential come in heavy packaging such as cardboard boxes, thick plastic jugs and glass jars.

Precycling is one of the first steps in preventing waste. The focus is to reduce waste and reuse. Precycling is different from recycling because of the decision made before the purchase. Precycling allows consumers to take actions before recycling is an option. With precycling there is no need to process, or transport recycled materials. Bulk buying is ideal for precycling in that sense.

Food and beverage prices are soaring, and they aren't coming down anytime soon. A solution would be buying bulk food and/or beverages in bins. Such food and beverage products are for example nuts, dried fruits, rice, paste, oatmeal, bulgur, herbs, spices, beans, cereal, tea, and coffee.

Consumers try often to reduce the packaging entry their home. A way to do this is by shopping at bulk bins. In theory, bulk buying is a triple win. It reduces packaging waste and allows for portion control, which, in turn, prevents product waste. It also saves consumers money if compared to the same item prepackaged.

Bulk bin retailers offer an extensive selection of products. Some stores have gravity-driven containers operated with levers; some have open bins with scoops. With an influx of grocers angling to enhance their value and sustainability propositions, many are expanding their bulk food sections across a variety of categories, which has in turn prompted an increase in bulk products sales.

People are now paying closer attention to the product they purchase. They are shopping smarter and turning to bulk products for budget and eco-friendly alternatives that don't lack in quality.

Several consumer trends bode especially well for bulk foods, including increased interest in at-home eating and cooking, as well as the economic benefits that offer consumers the ability to precisely purchase a desired quantity for a single recipe, thereby reducing waste.

Some stores have gravity-driven containers operated with levers; some have open bins with scoops.

Periodic cleaning of the current bulk dosing systems is required to prevent the appearance of the system from becoming dirty and to avoid hygiene problems.

For example, document JP2009007067A is known in the state of the art, disclosing To provide a new container for storing a bulk material, in particular, a coffee powder and taking out it into a tank. The container of JP2009007067A is keeping a closed tip and open tip, a hopper arranged in the container and narrowed toward a discharging opening and a cover which closes the tip of the discharging opening and the open tip of the container and can be bored. However, the container disclosed in JP2009007067A is complicated and can be improved.

Another prior art is CN111498250A disclosing a recyclable bulk food sale and transportation protection case, and relates to the recyclable bulk food sale. However, the invention focuses more on the transportation of these protection cases rather than the protection case itself.

Another prior art is CN106651493A disclosing an intensive selling platform for bulk food. The platform comprises a display module, a control module, a selling module, a handheld module, an indication module and an identifying module, wherein the identifying module is in communication with the control module and the selling module.

Current bulk dosing systems are working with standard canisters, where a retailer has to fill manually the product into the canister, losing the traceability and creating hassle in product handling. The whole process is time consuming and should be improved.

Periodic cleaning of the current bulk dosing systems is required to prevent the appearance of the system from becoming dirty and to avoid hygiene problems.

None of the above prior arts propose a solution or improvements on the traceability, the product handling, and the cleaning Therefore, it is an object of the present invention to provide a method which overcome the afore-mentioned drawbacks by providing a product container, a dispensing unit and a dispensing system comprising the product container and the dispensing unit allowing multiple dosing of a powdered food and/or beverage product from a flexible product container via a dedicated connected dosing system, allowing charging and discharging of the product container without the user being in contact with the dosed product.

These and other objects which become apparent upon reading the following description, are solved by the subject matter of the independent claim. The dependent claims refer to preferred embodiments of the invention.

3. Summary of the Invention

These aims and other advantages are achieved by a product container comprising an inner volume for receiving a food and/or beverage product, a rigid insert comprising linking means and an aperture allowing the delivery of the food and/or beverage product out of the inner volume of the product container and an interface comprising an outlet linked to the rigid insert via the linking means. The interface 4 is connectable to an external dispensing unit. The interface 4 is also movable for covering and uncovering the aperture 3 completely or to a certain extent.

Preferably, the interface is detachable from the product container 1.

Preferably, the linking means are configured as sliders.

The movement of the interface 4 is preferably vertical.

Preferably, the product container is flexible and compressible.

According to a second aspect of the invention, these aims, and other advantages are achieved by a dispensing unit for receiving a product container. Typically, the dispensing unit comprises a frame surrounding the dispensing unit, a handle attached to the frame in an initial position, a front door for opening and closing the dispensing unit 4.

The front door comprises an outlet plate for receiving an outlet. In the present invention, the outlet received by the outlet plate is the outlet of the interface of the product container.

Typically, the dispensing unit further comprises a tilting plate connected to the handle via an elastic means and further elastic means configured to maintain the handle in the initial position when there is not a downwards force applied to the handle.

Hence, the movement of the handle causes the elastic means to pull upwards the tilting plate.

Generally speaking, the front door may be connected to the frame via a horizontal axis. The connection between the front door and the frame allows the front door to move from an open to a closed position or vice-versa.

As a result of this connection, the tilting plate may tilt around the horizontal axis that connects the front door and the frame.

The downwards movement of the handle stretches the elastic means so that the elastic means can pull upwards the tilting plate.

Preferably, the dispensing unit may further comprise pins on the front door. The pins may be connected to the handle and to the outlet plate for moving the outlet plate.

The downwards movement of the handle causes the pins to be pushed upwards by the elastic means.

Preferably, the further elastic means are located on the front door of the dispensing unit.

Preferably, the further elastic means push the handle upwards when there is not a downwards force applied to the handle.

Preferably, the elastic means, and further elastic means may be springs.

According to a third aspect of the invention, these aims, and other advantages are achieved by a dispensing system comprising a product container and a dispensing unit according to the invention. In the dispensing system according to the invention, the interface of the product container is connected to the front door of the dispensing unit via the outlet plate of the front door of the dispensing unit.

For instance, the downwards movement of the handle causes the product container to be lifted by pulling upwards the tilting plate. At the same time, it also causes the outlet of the interface to be pulled downwards to uncover the aperture of the rigid insert completely or to a certain extent so that the food and/or beverage product is delivered from the inner volume of the product container through the outlet of the interface by gravity.

4. BRIEF DESCRIPTION OF THE DRAWINGS

5. DETAILED DESCRIPTION OF EXEMPLARY EMBODIMENTS

Figure 1:
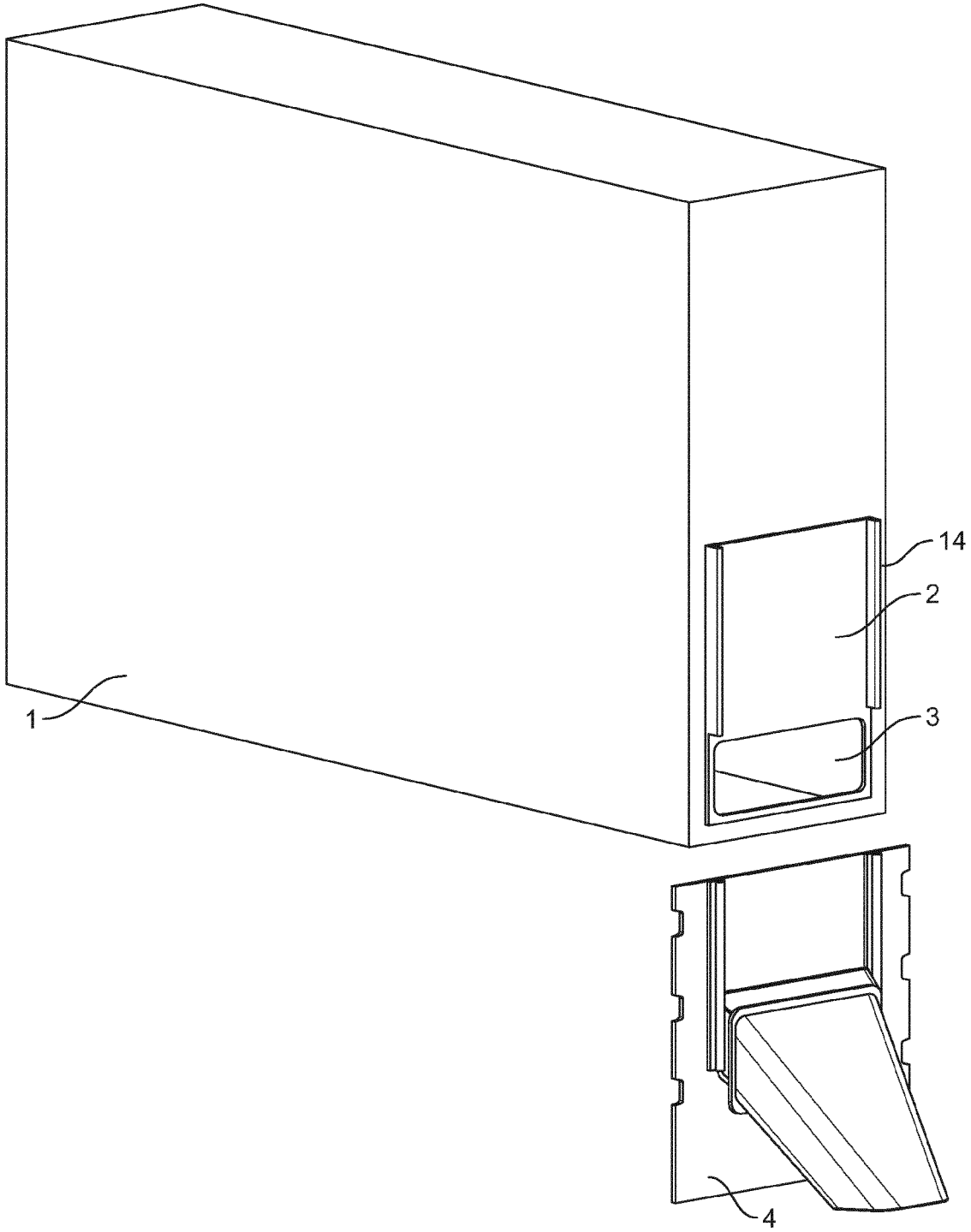
FIG. 1 is a side view of the product container before the insertion of the interface.

As illustrated in FIG. 1, the product container 1 has an inner volume for receiving a food and/or beverage product. The product container 1 has a rigid insert 2 comprising linking means 14. The linking means may be configured as sliders. The product container 1 has a sealed rigid insert 2 with an aperture 3 that is sealed with a membrane.

Before inserting the product container 1 into a dispenser, an interface 4 comprising an outlet is glided over the rigid insert 2, automatically removing the membrane and keeping the product container 1 closed by covering the aperture 3.

FIG. 1 illustrates the product container 1 before the insertion of the interface 4.

Figure 2:
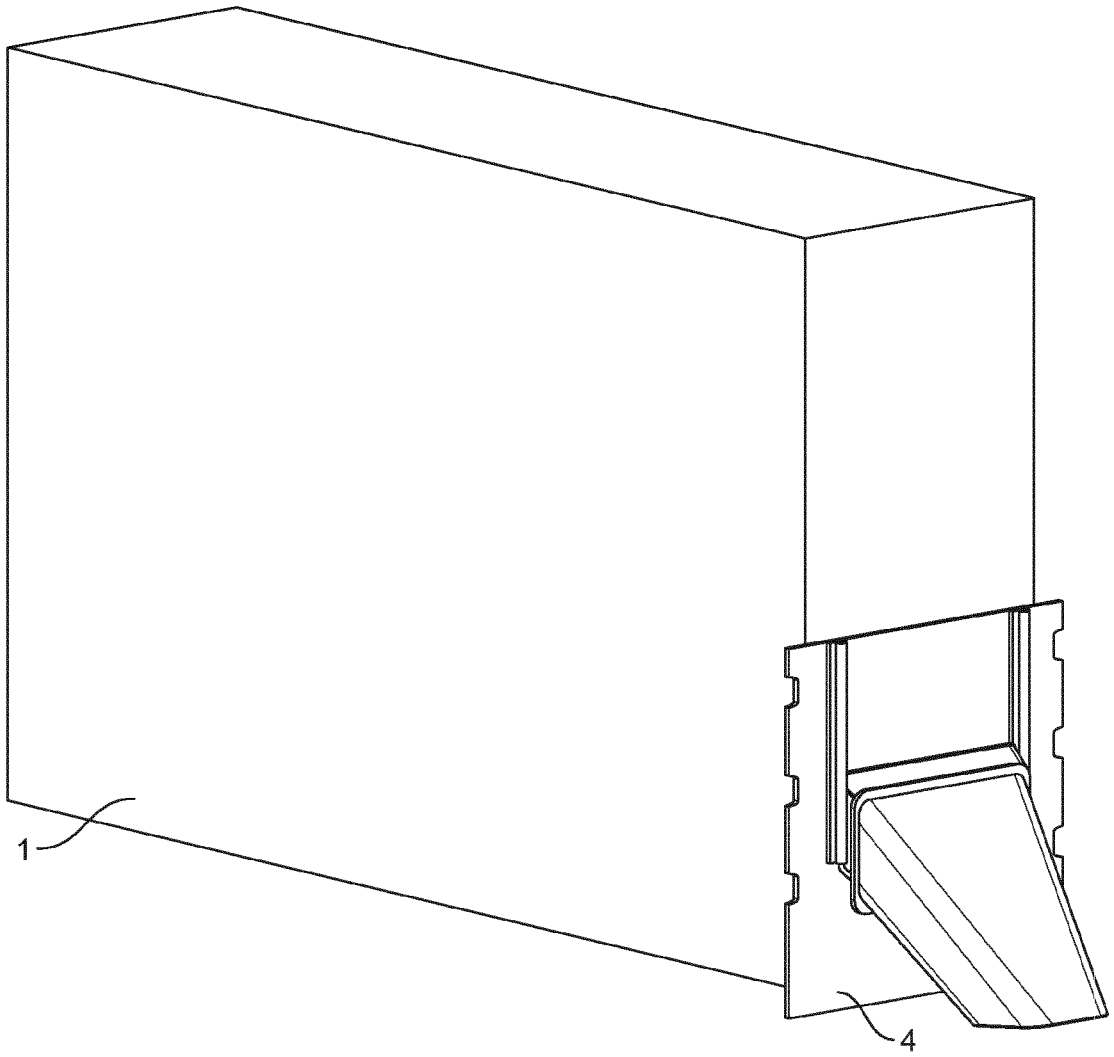
FIG. 2 is a side view of the product container after the insertion of the interface according to the invention.

FIG. 2 illustrates an exemplary embodiment of a product container 1 after the insertion of the interface 4 according to the invention.

The product container 1 is closed with the interface 4 as illustrated in FIG. 2. The food and/or beverage product is kept in the product container 1. As the outlet of the interface 14 is covering the aperture 3 of the rigid insert 2, it prevents the flow out of the food and/or beverage product from the inner volume of the product container 1.

As can be seen from the FIGS. 1 and 2, the interface 4 is detachable which allows the retailers to be able to use the same interface 4 multiple times.

The product container 1 is preferably made of plastic or paper.

Figure 3:
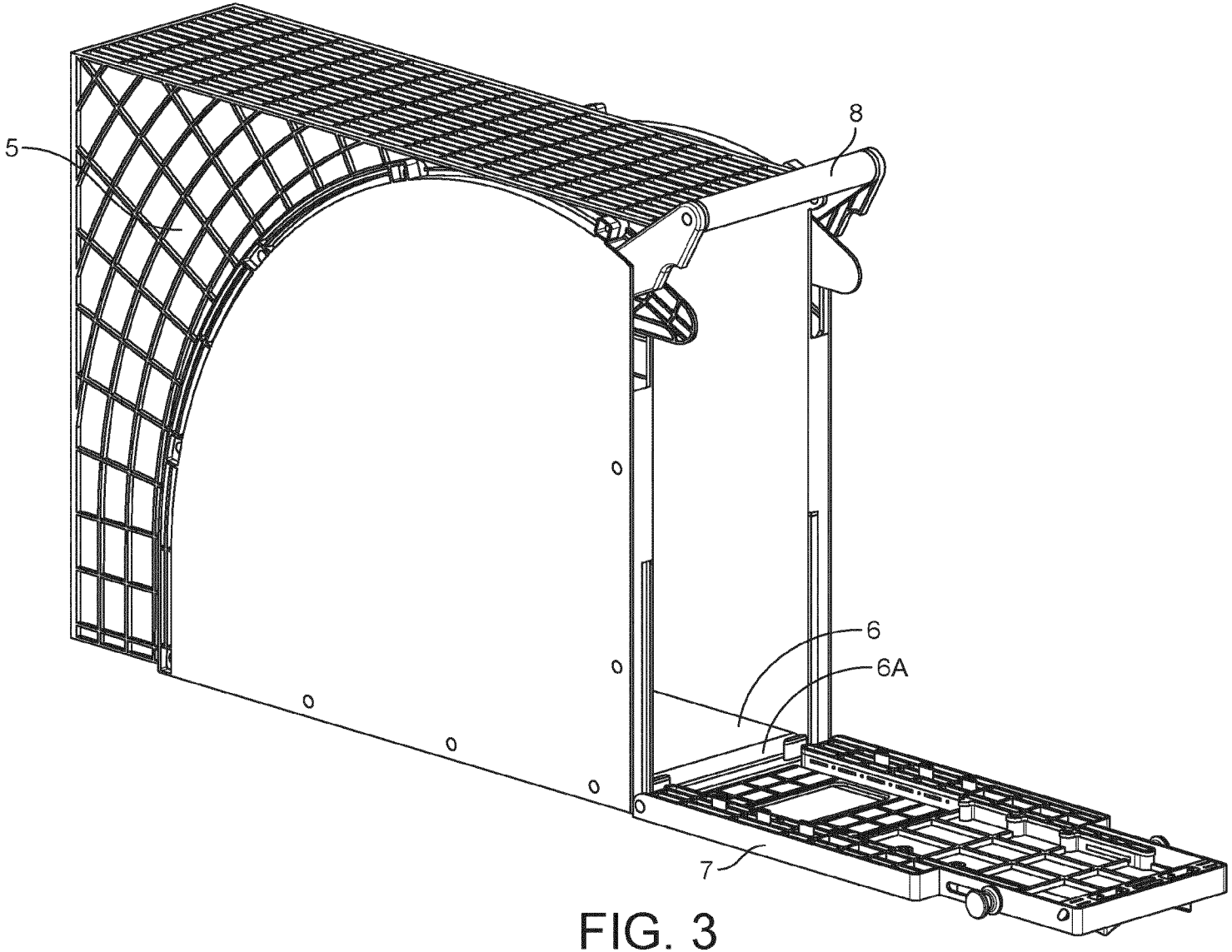
FIG. 3 is a side view of the dispenser according to the invention.

FIG. 3 illustrates an exemplary embodiment of a dispensing unit 4 according to the invention.

As illustrated in FIG. 3, the dispensing unit 4 comprises a frame 5 surrounding the dispensing unit 4 and a handle 8 attached to the frame. The position of the handle 8 illustrated in FIG. 3 is the initial position of the handle 8, which is the position of the handle when there is no force applied downwards to the handle 8. In the initial position, the handle 8 is totally released.

The dispensing unit 4 further comprises a front door 7 for opening and closing the dispensing unit 4. The front door comprises an outlet plate 12 as shown in FIGS. 5, 6, 7 and 11.

The dispensing unit further comprises a tilting plate 6 connected to the handle 5 via elastic means 10, for example springs. The connection of the handle 5 to the tilting plate 6 via elastic means 10 is illustrated in FIGS. 7, 8, 9 and 11.

The dispensing unit 4 may be preferably made of metal, plastic or partly wood.

As illustrated in FIG. 3, the front door 7 is connected to the frame 5 via a horizontal axis 6*a* allowing the front door to move from an open to a closed position, or vice-versa. Another utility of the horizontal axis 6*a* is that the tilting plate 6 is tiltable around the horizontal axis 6*a*.

The dispensing unit 4 further comprises elastic means 9 as illustrated in FIGS. 7, 8, 9 and 11. The further elastic means 9 are for example springs. The further elastic means 9 maintain the handle 8 in its initial position by pushing the handle 8 upwards when there is not a downwards force applied to the handle 8.

The handle allows 8 opening and closing of the interface 4 and puling the tilting plate 6 upwards when the product container 1 is sufficiently emptied in order to guarantee dispensing of all food and/or beverage product contained in the product container 1. By turning the bottom of the tilting plate 6 upside, the product container is compacted so that more product is emptied.

Figure 4:
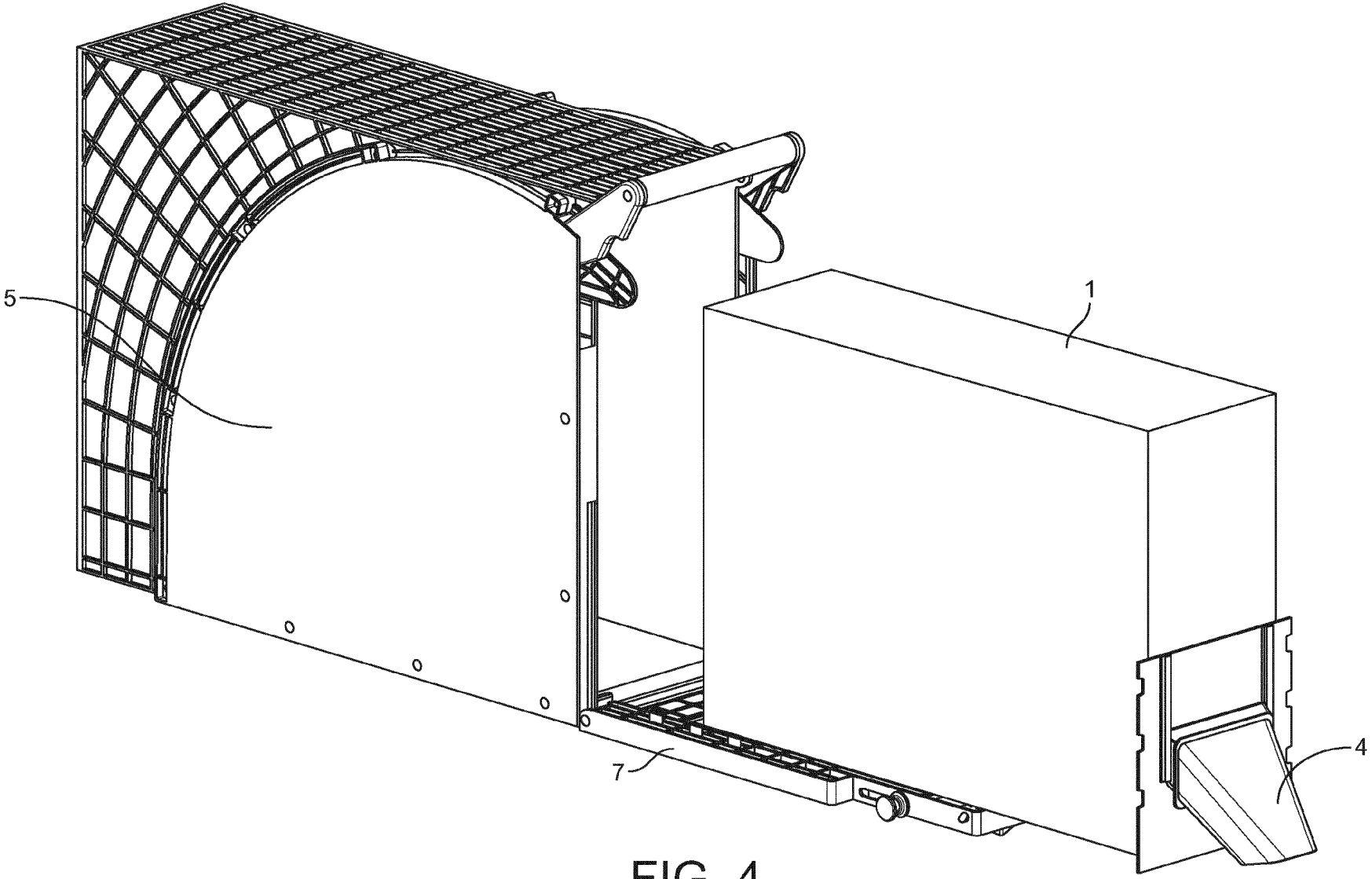
FIG. 4 shows the insertion of the product container into the dispenser according to the invention.

FIG. 4 illustrates an exemplary embodiment of a dispensing system according to the invention. The product container 1 is inserted into the dispenser 4 by opening the front door (7).

Figure 5:
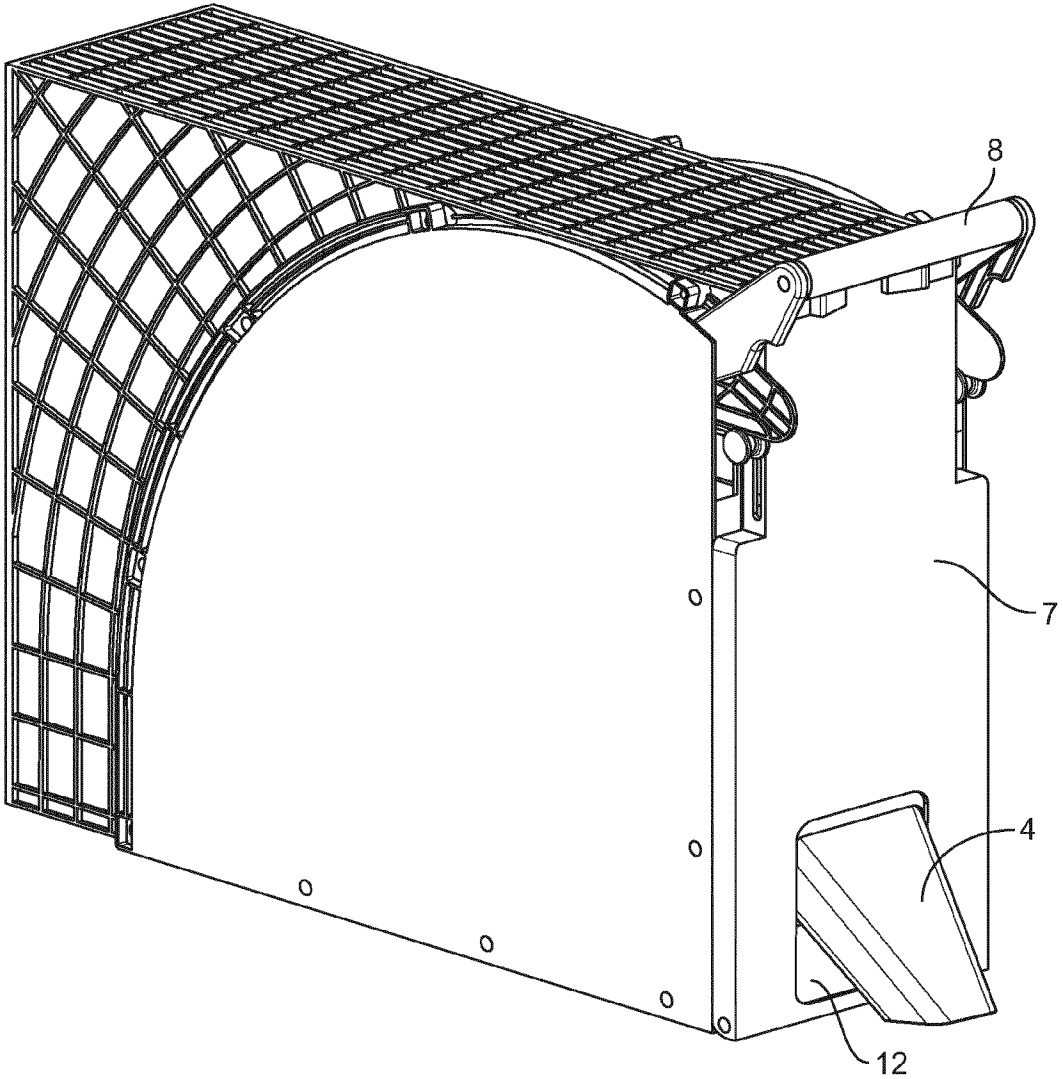
FIG. 5 shows the dispensing system after the insertion of the product container into the dispenser according to the invention.

FIG. 5 illustrates the dispensing system with a closed front door 7. By closing the front door 7, the outlet plate 12 of the front door 7 is connecting to the interface 4 in order to be able to open and close the interface 4 by moving the handle 8.

Figure 6:
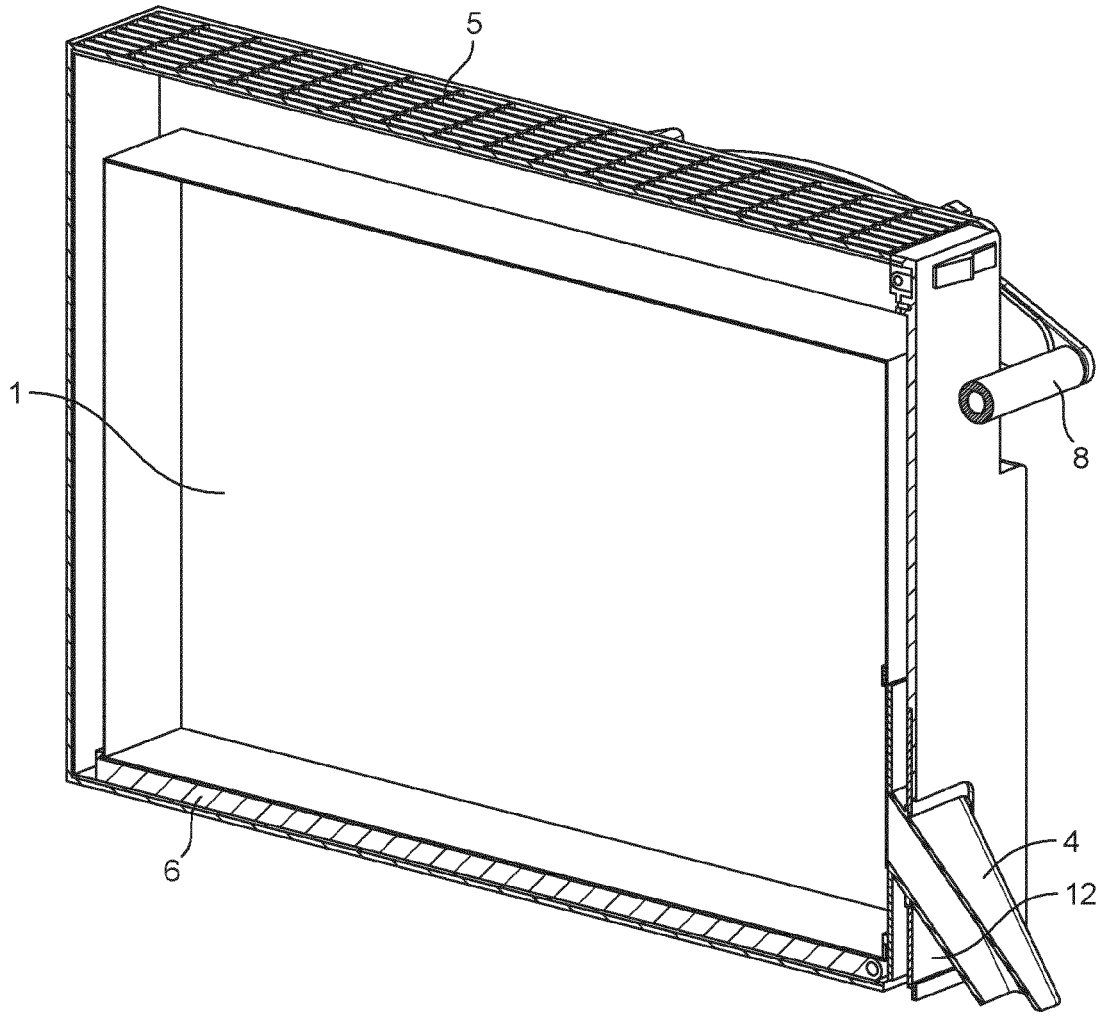
FIG. 6 is a cross-sectional side view of the dispensing system according to the invention.

FIG. 6 is a cross-sectional view of the dispensing system. The interface 4 of the product container 4 is closed and connected to the front door 7 of the dispenser 4 via the outlet plate 12, the handle 8 is in closed position, hold by further elastic means 9 in the front door and elastic means 10 between the handle and the tilting plate 6.

Both elastic means (9, 10) have different utilities. Elastic means 10 pull the tilting plate 6 upwards when there is a downwards force applied to the handle. The elastic means 10 are elongated and stretched whenever there is a downwards force applied to the handle to pull the tilting plate upwards.

In the contrary scenario, where there is not a downwards force applied to the handle, the further elastic means 9 push upwards the handle by applying an upwards force. This force brings the handle to its initial position. The handle is then totally released by the upwards force applied.

Figure 7:
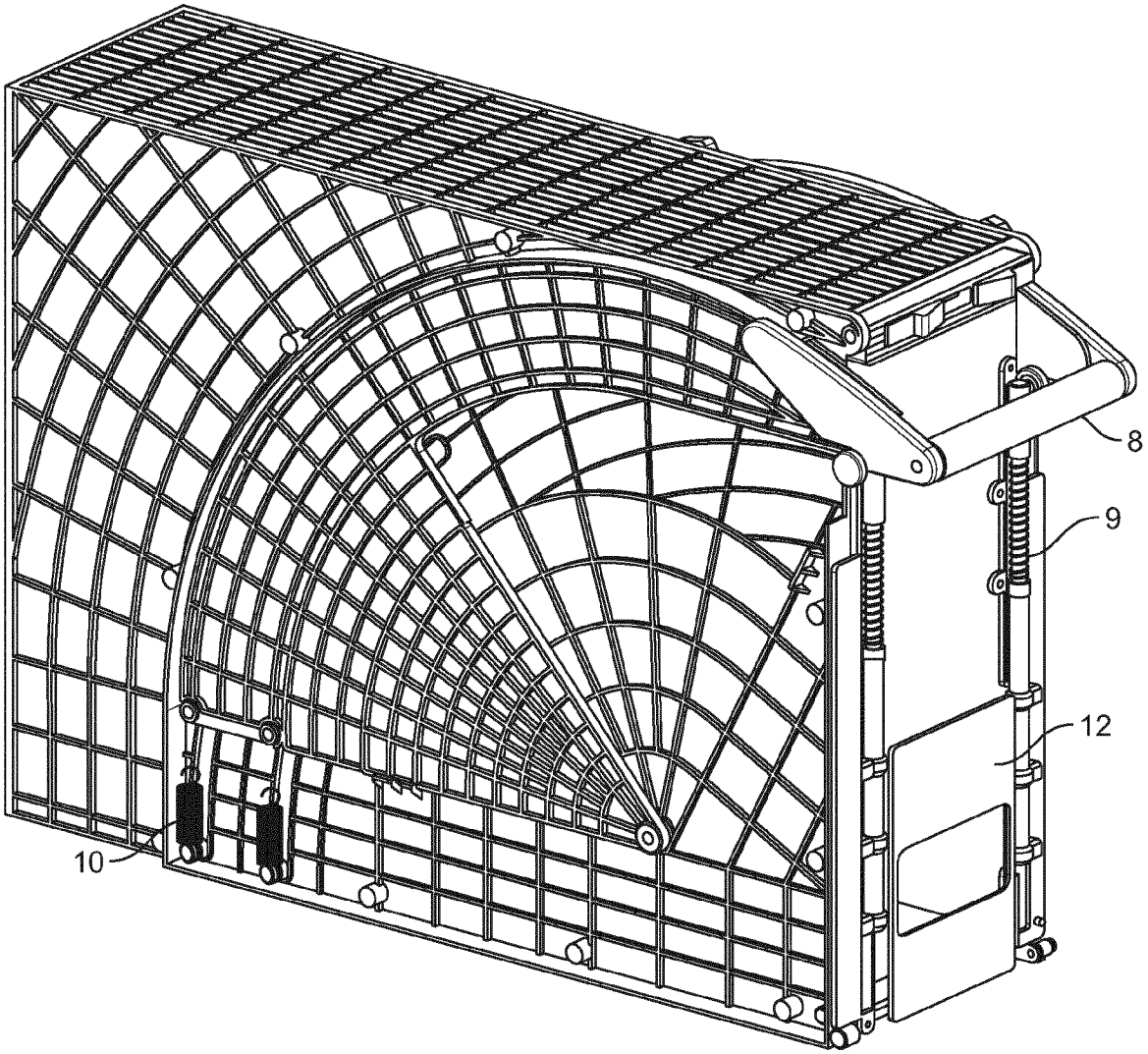
FIG. 7 is a side view of the dispensing system with elastic means according to the invention.

FIG. 7 illustrates the dispensing unit 4 without the product container 1, further elastic means 9 are pushing the handle 8 upwards when there is no force applied downwards, in the opposite sense of the force applied by further elastic means 9.

Further elastic means 9 are keeping the product container 1 with the interface 4 closed via the outlet plate 12. Further elastic means 10 are connecting the handle 8 with the tilting plate 6.

Figure 8:
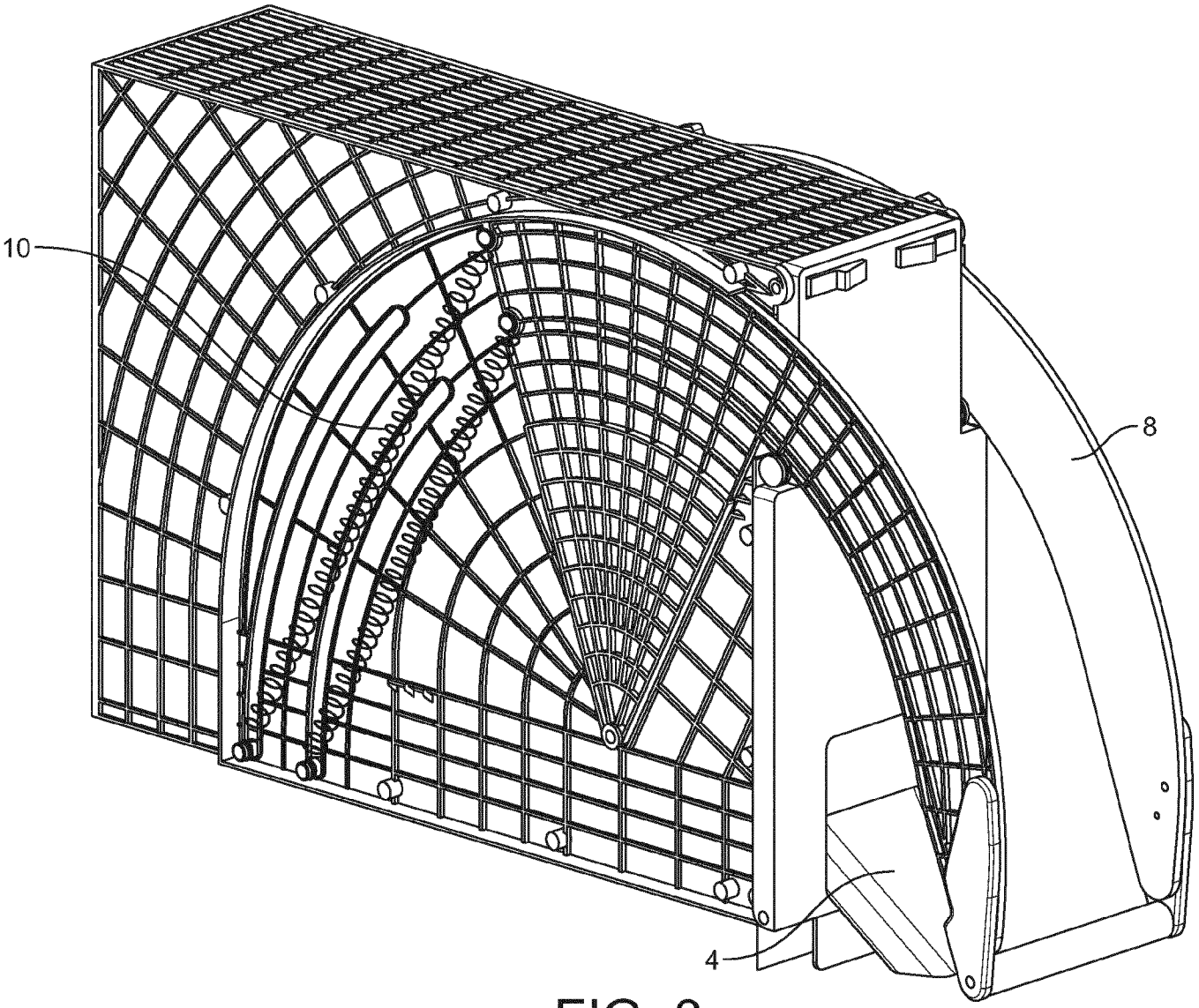
FIG. 8 is a side view of the dispensing unit with the handle pulled down according to the invention.

FIG. 8 illustrates the dispensing unit 4 with the product container 1 which form the dispensing system of the invention. FIG. 8 also illustrates the dispensing mode of the dispensing system: The handle 8 is pulling upwards the bottom of the tilting plate 6 via the elastic means 10. If there is enough space in the product container 1, the tilting plate 6 tilts and helps the food and/or beverage product flowing out in front through the outlet of the interface 4. In this figure, the product container 1 is full and the tilting remains horizontal.

Figure 9:
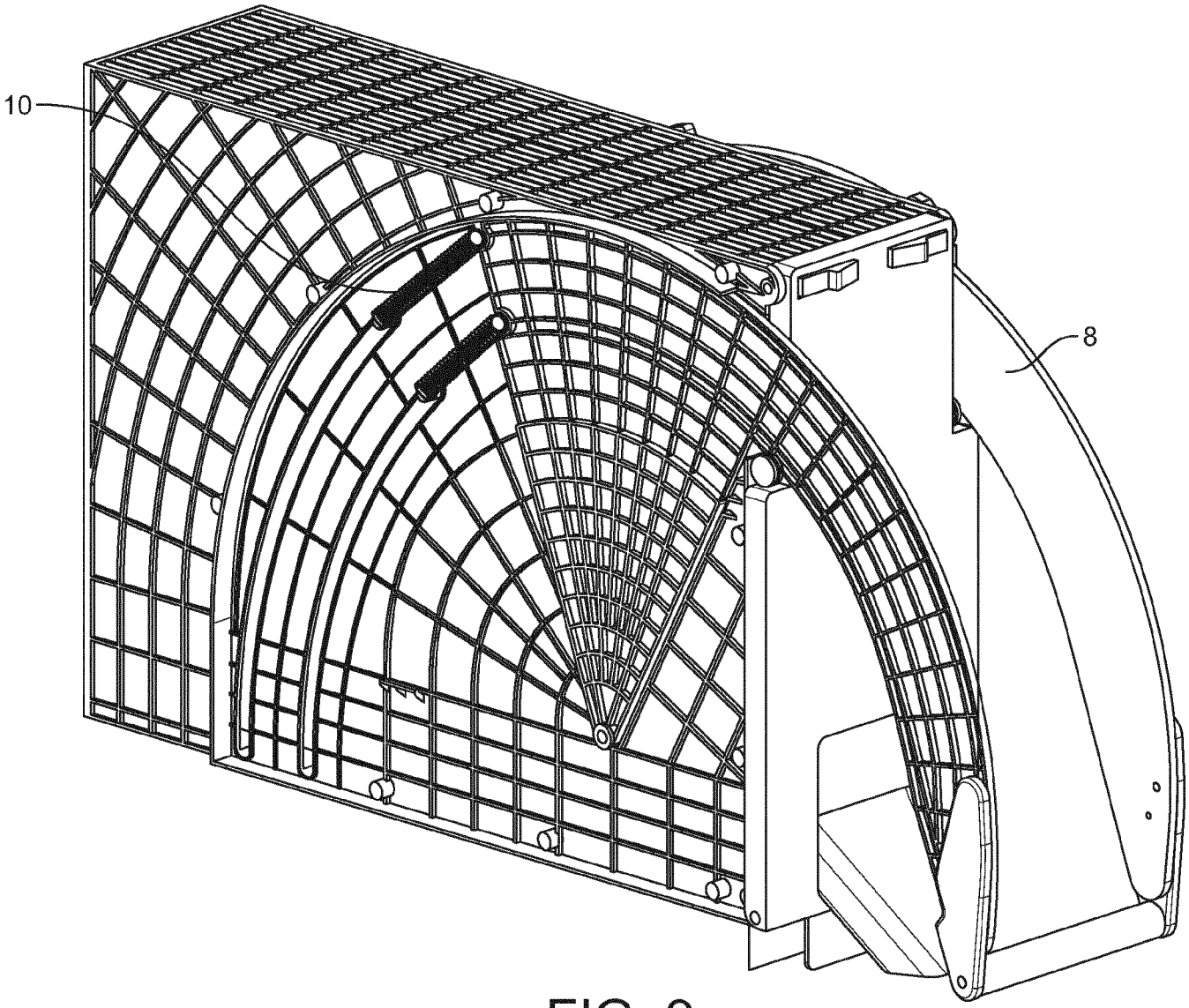
FIG. 9 is a side view of the dispensing unit with a product container almost empty according to the invention.

FIG. 9 illustrates the dispensing unit 4 with an almost empty product container 1. FIG. 9 differs from FIG. 8 in that the product container 1 is almost empty and therefore the handle 8 is pulling the tilting plate 6 upwards by the elastic means 10.

As illustrated in FIG. 9, once a downwards force applied to the handle, the movement of the handle causes the product container 1 to be lifted by pulling upwards the tilting plate 6 by the elastic means 10 and at the same time, the outlet of the interface 4 is pulled downwards to uncover the aperture 13 of the rigid insert 2 completely or to a certain extent so that the food and/or beverage product is delivered from the inner volume of the product container 1 through the outlet of the interface 4 by gravity.

If there is enough empty space in the product container 1, the tilting plate 6 tilts around the axis 6*a* and helps the food and/or beverage product flowing out through the outlet of the interface 4 by gravity. In FIG. 8, the product container is full and the tilting plate 6 remains horizontal, further elastic means 10 are elongated and stretched during the movement of the handle 8.

When the product container 1 is full, there is an upwards force applied to the bottom of the tilting plate 6 by the movement of the handle 8. However, there is as well a force applied to the tilting plate 6 in the opposite sense. The opposite downwards force of the weight of the product container 1 is greater than the upwards force applied to the bottom of the tilting plate 6. Hence, the tilting plate 6 does not move and countered by the downwards force of the weight of the product container 1.

When the product container 1 is not full, there is still a downwards force applied by the weight of the product container 1. However, in this scenario, the upwards force applied to the tilting plate 6 is greater than the force applied by the weight of the product container. Hence, the tilting plate 6 may be lifted to create a ramp.

Once the ramp is created, the food and/or beverage product flows out from the inner volume of the product container 1 so that the retailer or any other user of the dispensing system may easily dose the food and/or beverage discharged from the product container 1 multiple times using the same interface (4).

Figure 10:
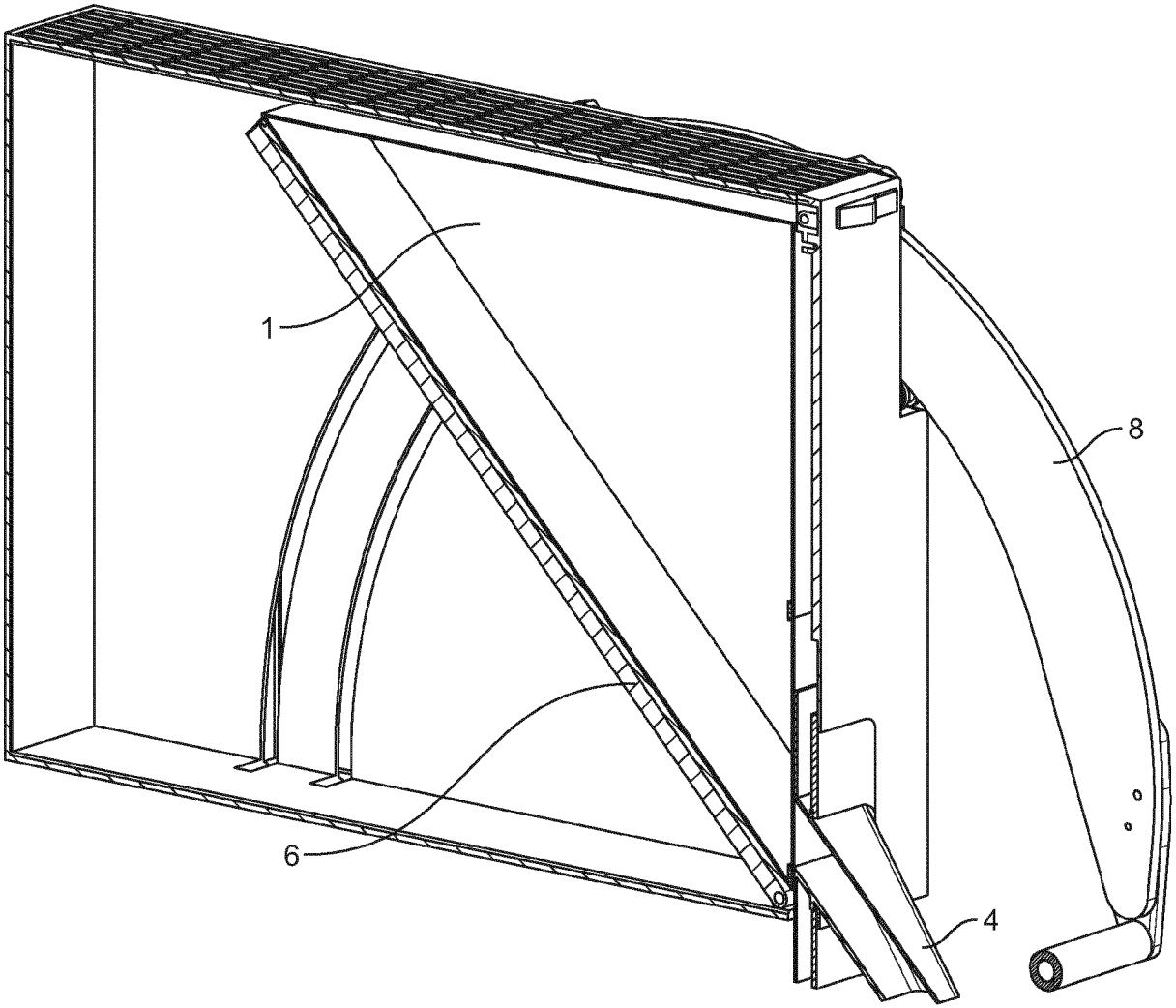
FIG. 10 is cross-sectional side view of the dispensing system according to the invention.

FIG. 10 is a cut view of the dispensing unit 4 with an almost empty product container 1. The cut view of FIG. 10 shows the tilting plate 6, as the product container 1 is almost empty and therefore compacted thanks to its flexibility, allowing an easy flowing out of the food and/or beverage product through the outlet of the interface 4. By releasing the handle 8, the further elastic means 9 will push up the handle 8 as well as close the product container 1 by pushing up the outlet of the interface 4, and therefore also moving back the tilting plate 6 into horizontal position.

By releasing the handle 8, the further elastic means 9 push up the handle 8 as well as close the product container 1 by pushing up the interface 4 so that it can cover the aperture (13), and therefore also moving back the tilting plate 6 into horizontal position. Each movement of the handle 8 allows therefore a sort of product agitation, facilitating dispensing once the aperture (13) is uncovered again.

Figure 11:
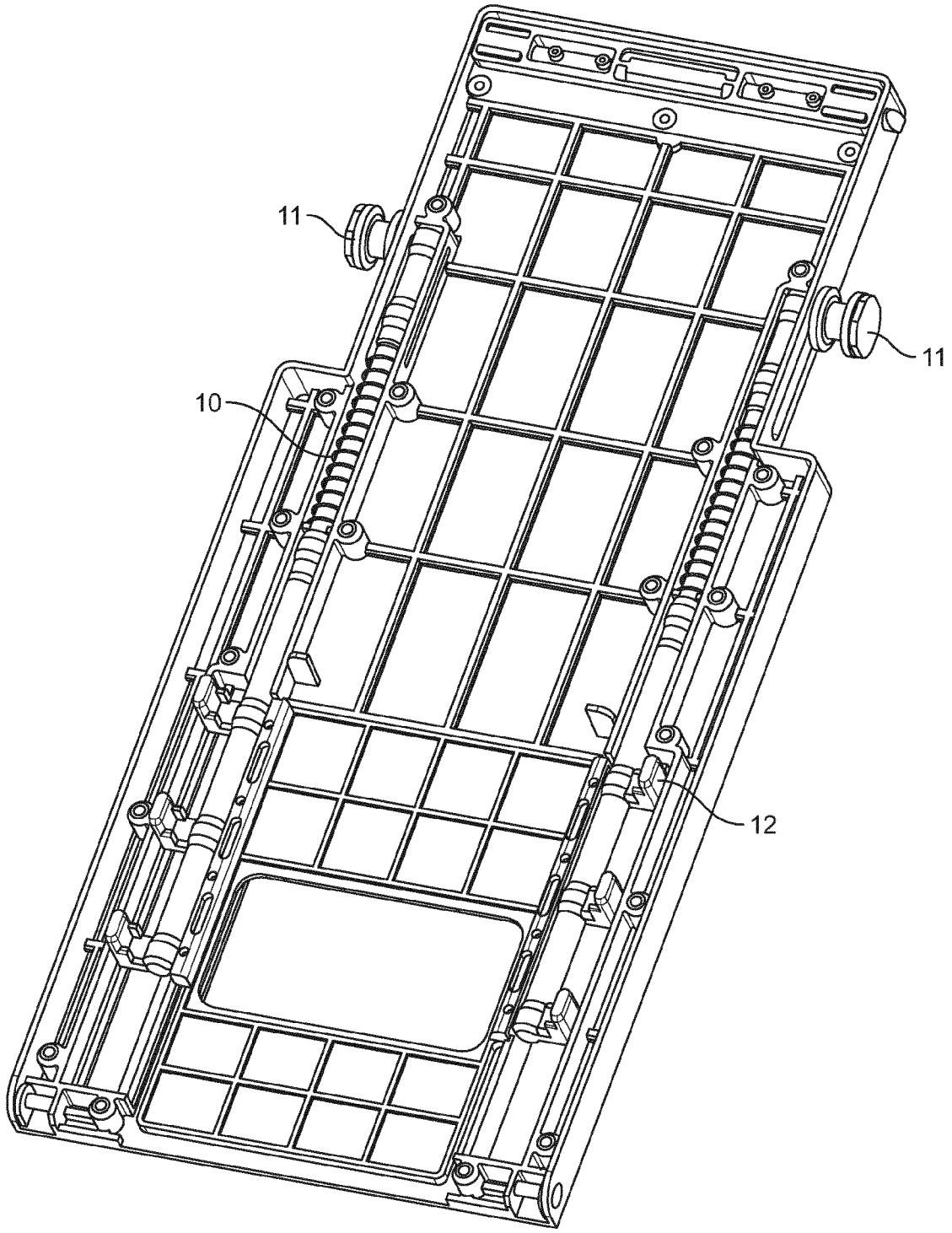
FIG. 11 is a view from above of the front door of the dispensing unit according to the invention.

FIG. 11 illustrates in detail the front door 7 of the product container 1. The handle 8 is laying on the pins 11 that are pushed upwards by the elastic means 10. The pins 11 are connected to the outlet plate 12 that allows positioning of the interface 4 of the pouch.

Figure 12:
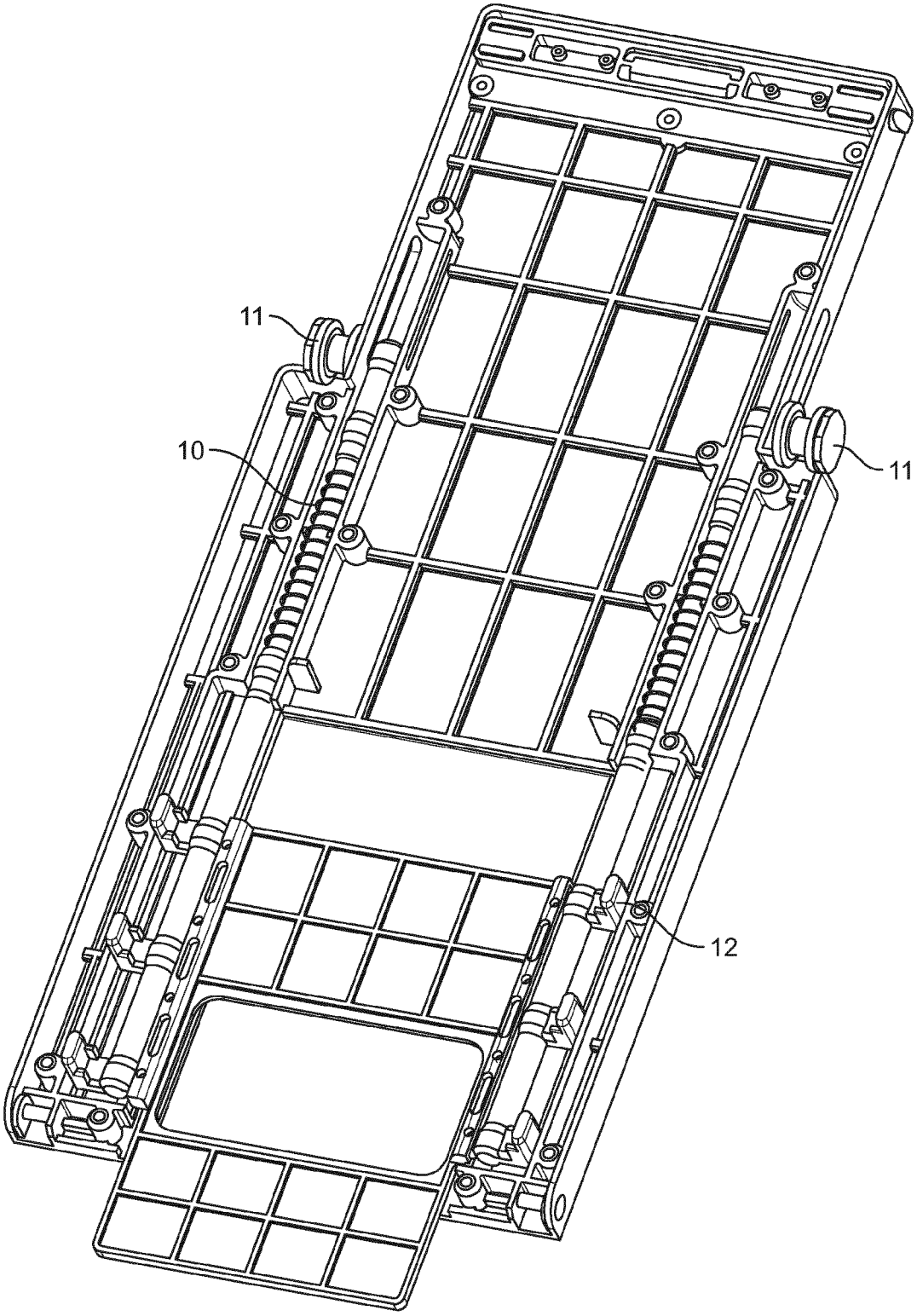
FIG. 12 is a view from above of the front door of the dispensing unit where the outlet plate is moved downwards.

FIG. 12 differs from the FIG. 11 in that, the outlet plate 12 is moved downwards. This movement of the outlet plate 12 causes the interface 4 to be moved in the same direction. The pins 11 are pushed down by the handle 8 against the elastic means 10 and pushing down the outlet plate 12 together with the interface 4.

Hence, the position of the outlet of the interface 4 is dependent to the position of the outlet plate 12. The position of the outlet plate 12 determines the covering and uncovering of the aperture 13.

The invention claimed is:

1. Dispensing unit for receiving a product container comprising:

a frame surrounding the dispensing unit, a handle attached to the frame in an initial position, a front door for opening and closing the dispensing unit, the front door comprising an outlet plate for receiving an outlet, a tilting plate connected to the handle via an elastic member, and a further elastic member configured to maintain the handle in the initial position when there is not a downwards force applied to the handle, wherein a movement of the handle causes the elastic member to pull upwards the tilting plate.

2. Dispensing unit according to claim 1, wherein the front door is connected to the frame via a horizontal axis allowing the front door to move from an open to a closed position.

3. Dispensing unit according to claim 2, wherein the tilting plate is tiltable around the horizontal axis.

4. Dispensing unit according to claim 1, wherein the elastic member is stretched during the downwards movement of the handle so that the tilting plate may be pulled upwards.

5. Dispensing unit according to claim 1, wherein it further comprises pins on the front door connected to the handle and to the outlet plate for moving the outlet plate.

6. Dispensing unit according to claim 1, wherein the movement of the handle causes the pins to be pushed upwards by the elastic member.

7. Dispensing unit according to claim 1, wherein further elastic member is located on the front door.

8. Dispensing unit according to claim 1, wherein further elastic member is configured to push the handle upwards when there is not a downwards force applied to the handle.

9. Dispensing unit according to claim 1, wherein the first elastic member and further elastic member are springs.

10. Dispensing system comprising a dispensing unit according to claim 1 and a product container comprising:

an inner volume for receiving a food and/or beverage product, a rigid insert comprising a linking member and an aperture allowing the delivery of the food and/or beverage product out of the inner volume of the product container and an interface comprising an outlet linked to the rigid insert via the linking member, the interface being connectable to an external dispensing unit wherein the interface is movable for covering and uncovering the aperture completely or to a certain extent inserted into the dispensing unit wherein the outlet of the interface is connected to the front door of the dispensing unit via the outlet plate, wherein the downwards movement of the handle causes the product container to be lifted by pulling upwards the tilting plate by elastic member and the outlet of the interface to be pulled downwards to open the aperture of the rigid insert completely or to a certain extent so that the food and/or beverage product is delivered from the inner volume of the product container through the outlet of the interface by gravity.

11. Dispensing system according to claim 10, wherein the interface is detachable from the product container.

12. Dispensing system according to claim 10, wherein the linking member is configured as a slider.

13. Dispensing system according to claim 10, wherein the movement of the interface is vertical.

14. Dispensing system according to claim 10, wherein the product container is flexible and compressible.

15. Dispensing system according to claim 10, wherein the front door is connected to the frame via a horizontal axis allowing the front door to move from an open to a closed position, and wherein the tilting plate is tiltable around the horizontal axis.

16. Dispensing system according to claim 10, wherein the elastic member is stretched during the downwards movement of the handle so that the tilting plate may be pulled upwards.

17. Dispensing system according to claim 10, wherein the dispensing unit further comprises pins on the front door connected to the handle and to the outlet plate for moving the outlet plate.

18. Dispensing system according to claim 10, wherein the movement of the handle causes the pins to be pushed upwards by the elastic member.

19. Dispensing system according to claim 10, wherein further elastic member is located on the front door.

20. Dispensing system according to claim 10, wherein further elastic member is configured to push the handle upwards when there is not a downwards force applied to the handle.

* * * * *